United States Patent [19]

Krämer et al.

[11] 4,315,118

[45] Feb. 9, 1982

[54] ELECTRIC CENTRIFUGAL SWITCH

[75] Inventors: Manfred Krämer, Schwieberdingen; Werner Schmid, Stuttgart; Hans-Dieter Cramer, Gerlingen, all of Fed. Rep. of Germany

[73] Assignee: Robert Bosch GmbH, Stuttgart, Fed. Rep. of Germany

[21] Appl. No.: 166,889

[22] Filed: Jul. 8, 1980

[30] Foreign Application Priority Data

Aug. 9, 1979 [DE] Fed. Rep. of Germany ..... 2932299
Apr. 10, 1980 [DE] Fed. Rep. of Germany ..... 3013858

[51] Int. Cl.[3] ..... H01H 35/14

[52] U.S. Cl. ..... 200/80 R; 318/793; 73/540; 29/622

[58] Field of Search ..... 310/68 E; 200/80 R; 318/462, 793; 73/538, 539, 540; 29/622

[56] References Cited

U.S. PATENT DOCUMENTS 2,623,962 12/1952 Holstein ..... 310/68 E

FOREIGN PATENT DOCUMENTS 1490452 4/1969 Fed. Rep. of Germany .... 200/80 R
1209075 2/1960 France ..... 200/80 R

*Primary Examiner*—Gerald P. Tolin
*Attorney, Agent, or Firm*—Edwin E. Greigg

[57] ABSTRACT

An electric centrifugal switch is proposed, in particular for the purpose of safety shutoff upon attainment of a shutoff rpm for fuel injection systems, electrically controlled in an open- or closed-loop manner, of internal combustion engines, which is not vulnerable to rotary oscillations and which effects a rapid shutoff. The centrifugal switch comprises a centrifugal pendulum secured by means of a metal band bearing on a revolving carrier element and a switch attached to the housing and provided with a switching distance from an actuation pin. The centrifugal pendulum carries a flyweight mass on the end of a first lever arm extending substantially in the direction of the rotary axis, and its second lever arm extending at least approximately rectangularly to the rotary axis, is held together with a metal band of the band bearing in constant contact on a roll-off surface located on the carrier element by a restoring spring and, in a preferred embodiment, by means of a supplementary spring element. The inclination and spring rate of the obliquely positioned restoring spring are so designed that the increase in spring force when the centrifugal pendulum is swinging outward is less than the corresponding increase in centrifugal force.

22 Claims, 6 Drawing Figures

ELECTRIC CENTRIFUGAL SWITCH

BRIEF SUMMARY OF THE INVENTION

The invention relates to an electric centrifugal switch having the purpose of safety shutoff upon attainment of a shutoff value developed by a shutoff rpm value derived for fuel injection systems, and in which a centrifugalpendulum arrangement is included in the preferred embodiment.

BACKGROUND OF THE INVENTION

A centrifugal switch is already known (German Offenlegungsschrift No. 1 490 452), whose centrifugal pendulum, in the form of a bell crank and secured via a metal band bearing on a revolving carrier element, acts via a contact screw disposed in the extension of the rotary axis of the centrifugal force switch upon a switch contact attached to the housing. In order to reduce wear from friction, the contact screw is centrally disposed in the extension of the rotary axis of the centrifugal force switch, but the centrifugal pendulum rests at every rpm on this contact screw; as a result, there is nevertheless some wear at this point, although it is reduced. The known centrifugal switch serves as an rpm contact governor for electric motors and is not suitable as a means of safety shutoff, upon attaining a shutoff rpm, for fuel injection systems in internal combustion engines which are electrically controlled in an open- or closed-loop manner, especially when used in Diesel engines.

Because of this band bearing, embodied by a leaf spring and secured in the form of a bridge between the carrier element and the centrifugal pendulum, and because the flyweight mass is disposed close to the rotary axis of the centrifugal switch, this known centrifugal switch exhibits a very low increase in centrifugal force when there are small changes in rpm, and the type of freely supporting band bearing used results in an imprecisely defined pivotal bearing point. Because of the slow manner of opening of the contact, there is contact burnoff. The restoring spring, embodied as a tension spring and suspended, inclined obliquely relative to the rotary axis, on the carrier element and on the centrifugal pendulum is so designed that even before attaining the nominal rpm the centrifugal pendulum rests on the contact screw, acting as an actuation pin; as a result, wear at this point is unavoidable. To actuate the movable contact element, the spring forces of both the contact and the band bearing embodied by a leaf spring and the initial tension of the restoring spring must all be overcome, and the effective force for lifting the movable contact element which remains is very small. In the case of soiling of the contacts, when the contacts stick or under external influences such as rotational fluctuations and shocks, further incalculable forces come into play as well; thus it would not be possible, with the known apparatus, to have a precisely maintainable means for safety shutoff upon attaining a predetermined rpm defined within narrow limits. The freely supporting band bearing which bridges the distance between the carrier element and the centrifugal pendulum and which is embodied by a bending spring would also not be suitable for absorbing the rotary acceleration forces occuring in Diesel engines.

OBJECT AND SUMMARY OF THE INVENTION

The centrifugal switch according to the invention and having the purpose of safety shutoff upon attainment of a shutoff value developed by a shutoff rpm value derived for fuel injection systems, and in which a centrifugal pendulum arrangement is included in the preferred embodiment.

A further advantage over the prior art provides that by means of the disposition of the flyweight mass on the end of the lever arm, extending substantially in the direction of the rotary axis, of the centrifugal pendulum, a sudden and rapid response of the switch is attained. Furthermore, by means of the selected structure of the second lever arm of the centrifugal pendulum, which together with the band bearing is pulled by the restoring spring against a rolloff surface on the carrier element, a precisely defined centrifugal pendulum rotary point is maintained and an articulated connection is attained between the centrifugal pendulum and the carrier element which is resistant to twisting and not vulnerable to oscillation and yet is not subject to bearing stress.

By means of the characteristics disclosed in the dependent claims, advantageous further embodiments of and improvements to the centrifugal switch having the purpose of safety shutoff upon attainment of a shutoff value developed by a shutoff rpm value derived for fuel injection systems, and in which a centrifugal pendulum arrangement is included in the preferred embodiment. Thus, by the application of the characteristics of claim 2 in normal operation of the centrifugal force switch, there is no friction at all between the actuation pin and the centrifugal pendulum, and by applying the characteristics of claim 3, the metal band of the band bearing is always unequivocally tensed between the centrifugal pendulum and the carrier element. With a centrifugal switch known from the document referred to above, whose restoring spring is embodied as a tension spring and is suspended, inclined obliquely to the rotary axis, on the carrier element and on the centrifugal pendulum, the metal band of the band bearing is, as a result of the characteristics of claim 4, under tensile stress in every operational position of the centrifugal pendulum; because of this, there is no load reversal at all in the region of the band bearing, and the momentary center of mass of the centrifugal pendulum and thus the effective lever arm of the centrifugal pendulum are always very precisely fixed. As a result of the adaptation, made according to claim 5, of the increase in spring force relative to the corresponding increase in centrifugal force a "snap effect" is attained which assures reliable response of the switch.

By applying the characteristics of claim 6, it is possible without additional structural components to make a simple correction in the initial tension of the restoring spring, and by applying the characteristics of claim 7 it is possible to attain a spring mounting which is easily carried out and to attain reliable locking in the installed position, without requiring a correction in the installed position of the spring. As a result of the characteristics of claim 8, the centrifugal pendulum rests in its outset position firmly on the inner stop during normal operation before the shutoff rpm is attained. Accordingly, "flap noises" and fluttering movements, and thus additional stress on the band bearing, are avoided and the band bearing is always subject to tensile stress. The characteristics of claim 9 not only enable a simple structure but also assure that the centrifugal pendulum is pressed against the rolloff surface of the band bearing, even after the shutoff rpm is exceeded, by means of the outwardly pivoted centrifugal pendulum and its position resting against the outer stop. The centrifugal pendulum, in an advantageous manner, can accordingly not lift up from the band bearing even upon a substantial overstepping of the shutoff rpm. Because of the arcuate rolloff path of the rolloff surface claimed in claim 11, the band bearing is stressed only slightly, and the second lever arm of the centrifugal pendulum, pivoting outward, performs a horizontal pressing or switching movement, by which of which a sufficiently large switching force is transmitted, at high switching speed, onto the actuation pin even when the contacts are sticking. As a result of the characteristics of claim 12, the "snap effect" mentioned in connection with claim 5 is additionally reinforced in an advantageous manner, and according to the characteristics of claim 13 it is assured that the second lever arm of the centrifugal pendulum performs the required pressing movement in the direction of the actuation pin. Through the characteristics of claim 14 or claim 15, when there is cold motor oil inside the housing which includes the centrifugal switch, this oil is prevented from acting on the movable switch contact and actuating it.

In order to assure that there is always a reliable contact of the centrifugal pendulum in the region of the band bearing even at high speeds and extremely high rotary accelerations, the contact of the centrifugal pendulum on the carrier element which is effected by the restoring spring is reinforced according to the characteristics of claim 16 by an additional spring element, which is embodied according to the characteristics of claim 17 as a strap spring. This spring element, by its attachment in the region of the band bearing, affects the functioning of the centrifugal switch practically not at all, yet it contributes substantially to an improved contact of the band bearing and to its long-term stability. The installed position of the strap spring is fixed by the characteristics of claim 18, and as a result of the pressure piece the point of transmission of the switching movement onto the actuation pin of the switch can be optimized independently of the form of the centrifugal pendulum. A transverse bending stress which occurs at very severe rotary oscillations can be reduced substantially by the characteristics of claims 19 and 20.

As a result of the method of operation characterized in claim 22 for the centering bore disclosed in claim 21, adjusting and setting devices for the restoring spring and for the inside position of the centrifugal pendulum are not required, because when the centering bore is in place, the centrifugal switch mounted on the tang of the drive shaft responds precisely to the established shutoff rpm.

The invention will be better understood and further objects and advantages thereof will become more apparent from the ensuing detailed description of preferred embodiments taken in conjunction with the drawings.

DETAILED DESCRIPTION OF THE PREFERRED EMBODIMENT

Figure 1:
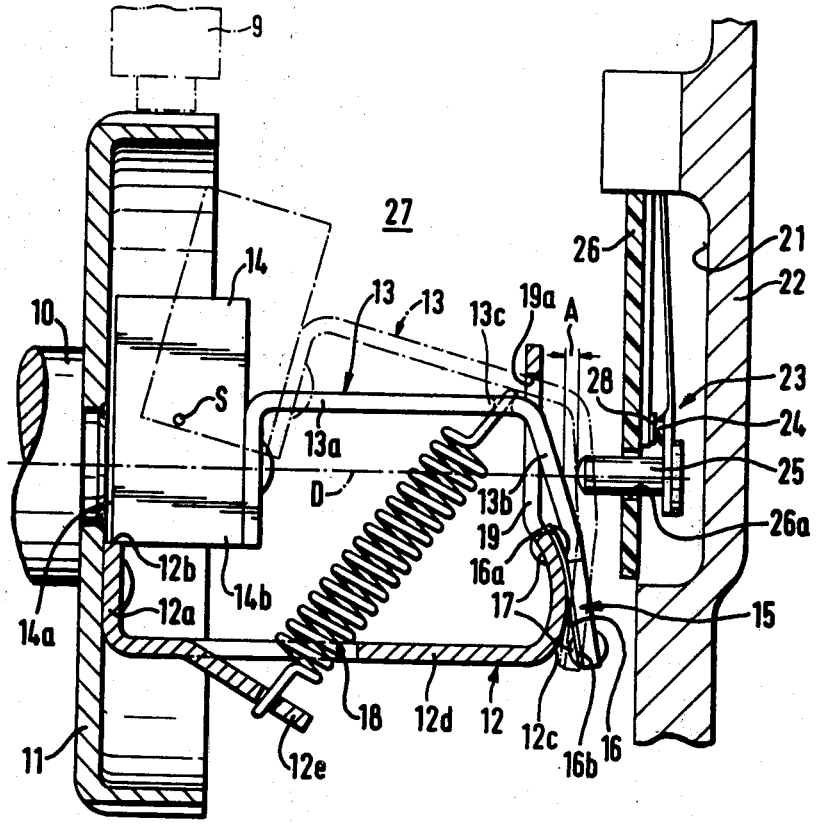
FIG. 1 is a lengthwise cross section on an enlarged scale taken of a first exemplary embodiment of the invention.

Referring now to the drawings, there is shown a flange 11 secured on a drive shaft 10 which may be embodied by the cam shaft of this Diesel engine or the injection pump or any arbitrary shaft driven by the engine. The flange 11, in the first exemplary embodiment shown in FIG. 1, is embodied as a pulse wheel for an electronic rpm transducer 9 indicated by dot-dash lines. A bracket-like carrier element 12 is riveted by its rectangularly bent end **12*a* to the flange 11. The outer edge 12*b* of the carrier element 12 points toward the rotary axis D, indicated by dot-dash lines, of the centrifugal switch, and simultaneously acts as the inside stop for a centrifugal pendulum 13**.

The centrifugal pendulum 13, embodied in the form of a bell crank, carries a flyweight mass 14 on the end of a first lever arm **13*a*, which extends substantially in the direction of the rotary axis D. A second lever arm 13*b* of the centrifugal pendulum 13, which extends at least essentially rectangularly to the rotary axis D is secured on the carrier element 12 by means of a band bearing 15. To this end, a metal band 16 of the band bearing 15 is tensed between a rolloff surface 12*c* on the carrier element 12 and the second lever arm 13*b* of the centrifugal pendulum 13, and it is secured with its one end 16*a* in the area of the end of the rolloff surface 12*c* extending toward the rotary axis D and with its other end 16*b* to the end of the second lever arm 13*b* which extends radially outward, away from the rotary axis D, by means of one rivet connection 17 each, the rivet connections 17** each comprising two rivets.

In its middle strut **12*d*, located between the bent end 12*a* and the rolloff surface 12*c* and extending parallel to the rotary axis D, the carrier element 12, which is made from a sheet-metal bracket, has a disengaged sheet-metal tongue 12*e*, bent outward and forming an acute angle with the rotary axis D, on which a restoring spring 18 embodied as a tension spring is suspended. The restoring spring 18 is installed obliquely in the centrifugal switch, being inclined at an angle of approximately 45° to the rotary axis D, and is suspended from the tongue 12*e* and from a middle region 13*c* of the centrifugal pendulum 13 located between the flyweight mass 14 and the outer end of the second lever arm 13*b* of the centrifugal pendulum 13. When the centrifugal pendulum 13 pivots outwardly, this middle region 13*c* passes through an opening 19 of the carrier element 12, whereupon the inner edge 19*a* of this opening 19, pointing away from the rotary axis D and located opposite the strut 12*d* of the carrier element 12, forms an outside stop for the centrifugal pendulum 13**.

The middle region **13*c* of the centrifugal pendulum 13 strikes this outside stop 19*a* when the centrifugal pendulum 13 has pivoted outwardly as indicated by dot-dash lines in the drawing. As a result, because of the flyweight mass 14 secured on the outermost end of the first lever arm 13*a*, a tilting moment is exerted on the centrifugal pendulum 13, which presses the outer end of the second lever arm 13***b* and thus the metal band 16 of the band bearing 15 firmly against the rolloff surface 12*c* on the carrier element 12. By this means the centrifugal pendulum 13 is prevented from lifting up from the band bearing 15. This pressing effect is also already attained in the illustrated inside position of the centrifugal pendulum 13 as a result of the obliquely positioned restoring spring 18, which draws the outermost end 14*a* of the flyweight mass 14 against the stop 12*b* and the second lever arm 13*b* of the centrifugal pendulum 13 against the rolloff surface 12*c*. By the arrangement of the stops 12*b* and 19*a* and by the inclination of the restoring spring, it is assured both in the inside position and in the outside position of the centrifugal pendulum that the metal band 16 of the band bearing 15 is always under tensile stress and the second lever arm 13*b* is always, together with the metal band 16, drawn or pressed against the rolloff surface 12*c*. Beyond this, the effective lever arm and the momentary rotary point are always fixed precisely for every position of the centrifugal pendulum 13.

The flyweight mass 14, in the illustrated inside position, has the rotary axis D passing through it somewhat eccentrically, so that a smaller portion 14*b* of the mass 14 is located on the side of the rotary axis D opposite the pivoting direction of the centrifugal pendulum 13. As a result, a highly progressive increase in centrifugal force is attained, which together with additional features to be discussed later brings about the desired, so-called "snap effect".

A switch 23 is disposed in a recess 21 of a cap 22 attached to the housing or of some housing part, and the movable contact 24 of this switch 23 carries an actuation pin 25. This actuation pin 25 is secured on the movable contact 24 in the extension of the rotary axis D of the centrifugal switch by means of a bore 26*a*, passing through a cover plate 26. In the illustrated inside position of the centrifugal pendulum 13, a switching distance A exists between the end of the actuation pin 25 protruding into the interior 27 of the centrifugal switch and the second lever arm 13*b* of the centrifugal pendulum 13. This switching distance A, during normal operation of the centrifugal switch, precludes any friction of any kind between the actuation pin 25 and the centrifugal pendulum 13. The cover plate 26, provided with the bore 26*a*, prevents an actuation by motor oil of the movable contact 24 which might otherwise occur, for instance, when there is motor oil in the interior 27 which has been thickened by cold.

The rolloff surface 12*c* is provided with an arcuate rolloff path which is so designed that when the centrifugal pendulum 13 has swung outward, the part of the lever arm 13*b* which acts on the actuation pin 25 performs a horizontal movement in the direction of the rotary axis D. Thus, no transverse forces are transmitted to the actuation pin 25, and wear at this point is avoided. It is also essential to the invention that the center of mass S of the flyweight mass 14 and the band bearing 15 are located on opposite sides of the rotary axis D, as a result of which the lever arm 13*b* always transmits a pressing movement onto the actuation pin 25.

The flyweight mass 14 attached to the end of the centrifugal pendulum 13, and the portion 14*b* thereof which pivots outward beyond the rotary axis D, as well as the inclination and the relatively yielding spring rate of the restoring spring 18 all contribute to the "snap effect" mentioned above. In other words, as soon as an excess rpm, to be designated as the shutoff rpm, has been attained, the centrifugal force pivots abruptly outward, and the lever arm 13*b* of the centrifugal pendulum 13 bridges the switching distance A and actuates the actuation pin 25 of the switch 23, before reaching the outside stop 19*a*. As a result, the movable contact 24 is lifted up from the fixed contact 28 secured on the cover plate 26, and the supply of electric current, not shown here in further detail, to a fuel injection system controlled electrically in an open-loop or closed-loop manner is accordingly interrupted.

In the following exemplary embodiments described in connection with FIGS. 2, 3, 5 and 6, identical elements or those with identical functions are given identical reference numerals, while those with modified structure are given primes; new elements are given new reference numerals.

In the second exemplary embodiment, the carrier element 12' is embodied as an approximately box-like sheet-metal molded element and is secured with three bent flange elements to a flange 11', embodied as a sheet-metal disc, by spot welding. The flange 11' provided with the carrier element 12' is screwed by means of three screw connections 31 to a pulse wheel 32 of the electronic rpm transducer 9, the pulse wheel 32 being secured on the drive shaft 10'. The illustrated installed position of the carrier element 12' is fixed by means of a centering bore 33 which receives a tang 10*a* of the drive shaft 10'.

The flyweight mass 14 of the centrifugal pendulum 13' secured on the lever arm 13*a'* is supported in the inside or resting position shown on an inside stop 12*b'* embodied by the strut 12*d'*, and the restoring spring 18 is suspended both on the carrier element 12' and on the centrifugal pendulum 13' by means of bolts 36, which are placed in indentations 34 of the strut 12*d'* and indentations 35 in the middle region 13*c'* of the centrifugal pendulum 13' and are passed through eyes 18*a* of the restoring spring 18. Acting as the outside stop for the centrifugal pendulum 13' are two inwardly bent sheet-metal elements 19*a'* of the carrier element 12', and the flyweight mass 14 is laterally guided, with little friction, by protruberances 40 on the side walls of the carrier element 12'.

A pressure piece 37 made from a sheet-metal strip is secured on the second lever arm 13*b'* of the centrifugal pendulum 13' and serves to transmit the switching movement of the centrifugal pendulum 13' onto the actuation pin 25 of the switch 23'. The switching distance A is fixed by a variable mounted position of the switch 23', and the actuation pin 25, as in the first exemplary embodiment, passes through a bore 38*b* in a rigid carrier plate 38, which receives the fixed switching contact 28. The carrier plate 38 surrounds the actuation pin 25 with a rim region 38*a* which is at least one centimeter wide. This rim region 38*a* is sufficient for shielding the movable contact 24 of the switch 23' from the motor oil which, when it is cold, is delivered approximately in the center of the axis in the axial direction.

Figure 2:
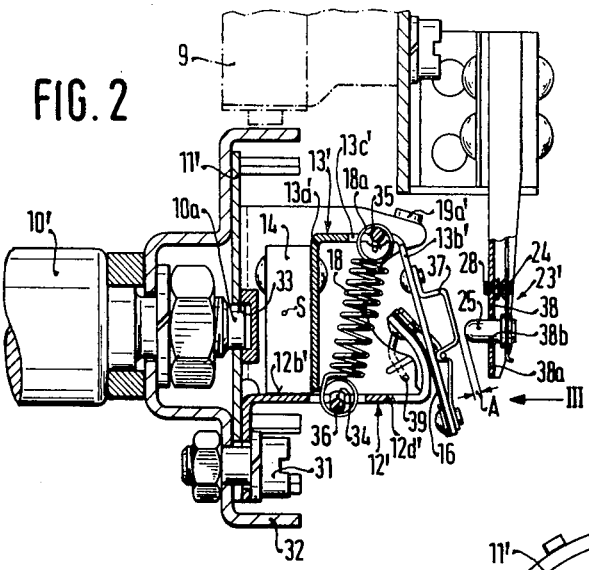
FIG. 2 is a lengthwise section on a reduced scale taken of a second exemplary embodiment of the invention.
Figure 3:
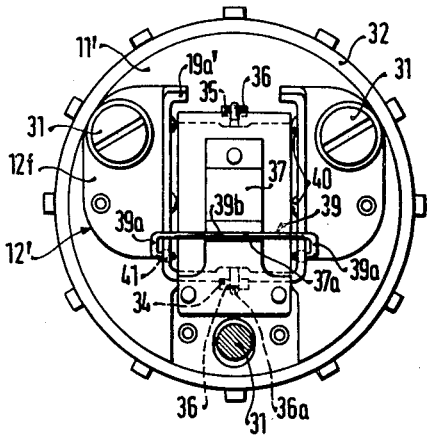
FIG. 3 is a view in the direction of the arrow III of FIG. 2.

This second exemplary embodiment shown in FIGS. 2 and 3 is distinguished from the first exemplary embodiment shown in FIG. 1 substantially by a spring element 39, embodied as a bracket spring, which is subject to an initial tensioning force and which, in the region of the contact point of the band bearing 15 (that is, the contact points between the second lever arm 13*b'* of the centrifugal pendulum 13' and the metal band 16 and between the metal band 16 and the carrier element 12'), encloses these elements and holds them together. For this purpose, the bracket spring 39 is suspended with two bent spring ends 39*a* in bores 41 of the carrier element 12' and rests with a middle bracket portion 39*b* in a spring holder 37*a*, which is embodied by means of an appropriately crimped shaping of the pressure piece 37 as a depression in this pressure piece.

Figure 4:
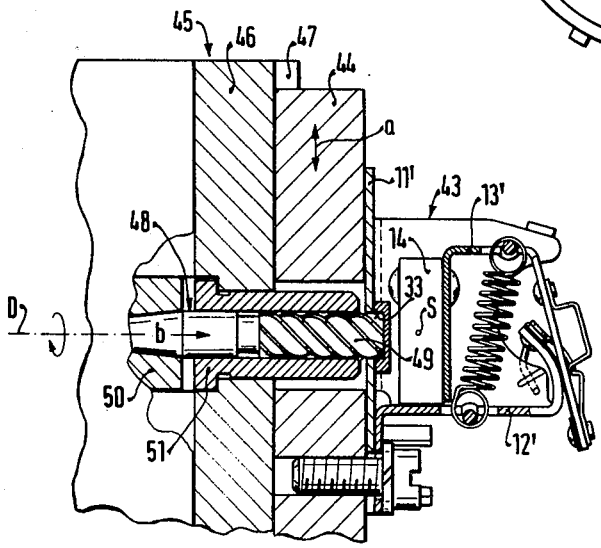
FIG. 4 is a simplified representation in cross section of an apparatus for drilling a centering bore located in the carrier element for the second exemplary embodiment shown in FIGS. 2 and 3.

In FIG. 4, in simplified form, are shown the most essential components of an apparatus 45, which serve to produce the centering bore 33 in the flange 11' of the carrier element 12', with a simultaneous establishment of the predetermined shutoff rpm of the centrifugal switch.

To this end, the flyweight unit, substantially comprising the flange 11', the carrier element 12' and the centrifugal pendulum 13' and here designated by reference numeral 43, of the centrifugal switch described in connection with FIGS. 2 and 3 is secured on a receiver flange 44 of the bore apparatus 45 with the center of mass S of the flyweight mass 14 being at first located approximately in the rotary axis D. The receiver flange 44 can be displaced in the rotary direction about the rotary axis D via a drive flange 46 of the bore apparatus 45 and is displaceable on this drive flange 46 by means of a sliding guide 47 in the direction of the pivoting movement of the centrifugal pendulum 13' and perpendicular to the rotary axis D in such a manner that the center of mass S can be displaced from its original position into a position more remote from the rotary axis D.

The establishment of the shutoff rpm and the drilling of the centering bore 33 now proceeds as follows:

(a) The flyweight unit 43 is secured to the receiver flange 44 of the bore apparatus 45;

(b) the receiver flange 44 is driven together with the drive flange 46 at the prescribed shutoff rpm;

(c) the installed position of the flyweight unit 43 is displaced out of the original mounted position into a position relative to the center of mass S which is more remote from the rotary axis D, either continuously with a running drive flange 46 by means of the receiver flange 44 which is adjustable perpendicular to the rotary axis D or iteratively by means of the step-by-step adjustment of the receiver flange 44 or by the step-by-step displacement of the flyweight unit 43 on the receiver flange 44, until such time as the centrifugal pendulum 13' pivots outward for the purpose of interrupting contact;

(d) in the position of the flyweight unit 43 furnished by the method step (c) above, the centering bore 33 is drilled by means of a drill tool 48 located in the rotary axis of the drive flange 46, the drill tool 48 in the simplified representation of FIG. 4 substantially comprising a face mill or a blind bore drill 49, which is driven via a more spindle 50 and can be displaced in the direction of the arrow b and is guided in a bore bushing 51 secured in the drive flange 46.

The centering bore 33, produced as a blind bore, has the advantage that during drilling the shavings are kept away from the flyweight unit 43; however, in principle, a through bore drilled by a spiral drill could also act as the centering bore.

As a result of this work method having the above method steps a through d, the shutoff rpm of the centrifugal switch is precisely and invariably fixed, and no further adjusting or establishing steps are required, because the flyweight unit 43 is centered on the tang 10*a* of the drive shaft 10' during mounting on the pulse wheel 32 (see also FIG. 2).

If the receiver flange 44 of the bore apparatus 45 is so embodied that it can be adjusted when the apparatus is in operation, then there is an enormous saving of time, especially in the case of mass production.

So that the restoring spring 18 always remains in the central position, the bolts 36 are provided, as may be seen in FIG. 3, with a central hollow throat 36*a* for the eyes 18*a* of the restoring spring 18, and the indentations 34 and 35 in the carrier element 12' and the centrifugal pendulum 13' also receive the bolts 36 in their axial direction in such a manner that their installed position is unequivocally fixed in the middle of the two structural parts. Thus the restoring spring 18 is prevented from being displaced sidewise and the shutoff rpm is prevented from being changed as a result of friction between the spring and the structural parts.

Figure 5:
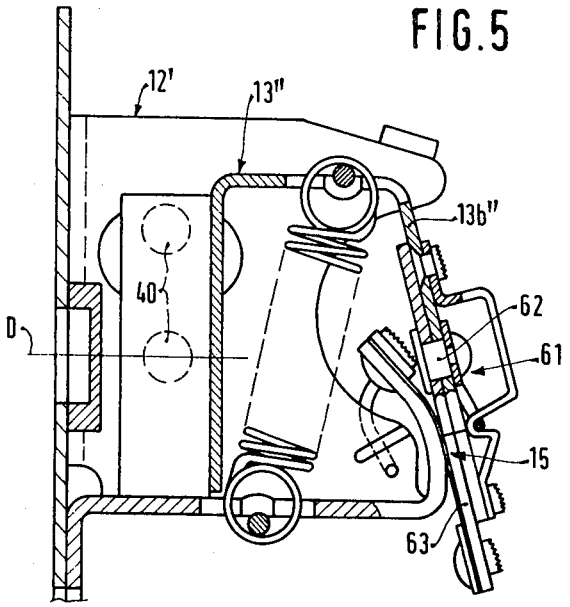
FIGS. 5 and 6 each represent a detail essential to the invention for the third and fourth exemplary embodiments, respectively.
Figure 6:
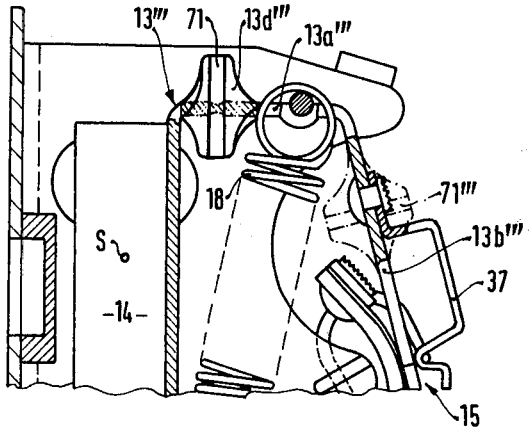

In FIGS. 5 and 6, the characteristics essential to the invention are shown for the third and fourth exemplary embodiments, on an enlarged scale. Both embodiments have characteristics which preclude the transmission of a bending stress onto the band bearing 15 perpendicular to the normal bending stress. A perpendicular bending stress occurs to an especially severe extent when the centrifugal switch is mounted directly on the cam shaft of the injection pump and thus must absorb the impacts of rotary moment imparted by the cams. The centrifugal pendulum 13'' of the third exemplary embodiment shown in FIG. 5 is provided with an articulation point 61 for this purpose, whose rivet-like connecting element 62 articulatedly connects a part of the centrifugal pendulum 13'' which is firmly connected with the flyweight mass 14 and embodied by the second layer arm 13*b''* with a sheet-metal tongue 63 riveted on the band bearing 15. The articulation point 61, embodied as a rotary bearing, is disposed in the rotary axis D, in order substantially to keep the tilting movements of the flyweight mass 14 or of the centrifugal pendulum 13'', which cannot be prevented by the lateral protuberances 40 in the carrier element 12' even though these tilting movements may be small, away from the band bearing 15.

The centrifugal pendulum 13''', shown only in part in FIG. 6, of the fourth exemplary embodiment is provided with an intentional bending point 71, instead of with the articulation point 61 described in connection with FIG. 5. This intentional bending point 71 is embodied by a thin wall point inside an edgewise region 13*d'''* of the second layer arm 13*a'''* of the centrifugal pendulum 13'''. This edgewise region 13*d'''* is produced by twisting the flat band cross section of the second lever arm 13*a'''*, and the thinness of the wall required for the elastic intentional bending point 71 is indicated by the cross section of this region entered in dot-dash lines in the region 13*d'''*. The intentional bending point 71 disposed between the restoring spring 18 and the flyweight mass 14 keeps the fluttering movements generated by rotary oscillations and performed by the flyweight mass 14 away from the band bearing 15. If, because of the eccentrically located center of mass S of the flyweight mass 14, the tilting movements should overcome the flyweight mass 14, then the intentional bending point 71 can also be attached on the second lever arm 13*b'''*, as indicated by dot-dash lines at 71'''. To this end, the form of the pressure piece 37 would have to be slightly modified.

The centrifugal switch according to the invention intentionally exhibits a high degree of hysteresis by which the switch 23 or 23' is again closed once the rpm has dropped substantially. Thus in the case of a problem the supply of electric current is immediately resumed and the motor begins to swing back and forth when the rpm is decreasing only slightly.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An electric centrifugal switch, in particular for the purpose of safety shutoff upon attaining a shutoff rpm for fuel inejection systems, electrically controlled in an open- or closed-loop fashion, of internal combustion engines, comprising a housing, a centrifugal pendulum in the form of a bell crank supported by a metal band bearing means on a carrier element connected with a drive shaft and having an electric switch attached to the housing, the switch being provided with an actuation pin disposed in the extension of the rotary axis of the driveshaft, the actuation pin being actuatable in the sense of interrupting contact by means of the centrifugal pendulum moving under centrifugal force and counter to the force of a restoring spring tensed between the centrifugal pendulum and the carrier element, the centrifugal pendulum carrying a flyweight mass on the end of a first lever arm extending substantially in the direction of the rotary axis of the drive shaft, the metal band of the band bearing being secured between a second lever arm of the centrifugal pendulum extending at least approximately perpendicularly to the rotary axis and a rolloff surface overlapping this lever arm and located on the carrier element and being held by the restoring spring (18) under tensile stress and in contact with the rolloff surface (12*c*, 12*c'*).

2. A centrifugal switch as defined by claim 1, wherein the second lever arm, when the centrifugal pendulum is in its position of rest contacting an inside stop, is at a switching distance from the actuation pin.

3. A centrifugal switch as defined by claim 1, wherein the metal band of the band bearing is tensed between the rolloff surface and the second lever arm and is secured with its one end in the region of the end of the rolloff surface extending toward the rotary axis and with its other end on the end of the second lever arm extending radially outward away from the rotary axis.

4. A centrifugal switch as defined by claim 3, wherein the restoring spring is embodied as a tension spring and is suspended, obliquely inclined toward the rotary axis, on the carrier element and on the centrifugal pendulum, the inclination and the spring rate of the restoring spring are so designed that in every position of the centrifugal pendulum its second lever arm and the metal band are drawn against the rolloff surface.

5. A centrifugal switch as defined by claim 4, wherein the inclination and spring rate of the restoring spring are so designed that the increase in spring force when the centrifugal pendulum is swinging outward is smaller than the corresponding increase in centrifugal force.

6. A centrifugal switch as defined by claim 4, wherein the carrier element is embodied as a shaped sheet-metal element and the restoring spring is suspended on a sheet-metal tongue bent outward from the carrier element, the position of which tongue is variable by means of further bending for the purpose of correcting the initial tension of the restoring spring.

7. A centrifugal switch as defined by claim 4, wherein the carrier element is embodied as a shaped sheet-metal element, and the restoring spring is suspended on the carrier element and on the centrifugal pendulum, respectively, by means of bolts placed in indentations on the carrier element and/or the centrifugal pendulum and inserted through eyes of the restoring spring.

8. A centrifugal switch as defined by claim 7, wherein the restoring spring draws the centrifugal pendulum in its resting position both against the rolloff surface and against an inside stop.

9. A centrifugal switch as defined by claim 8, wherein the carrier element has both the inside stop for the outer end of the flyweight mass contacting this stop in the resting position and an outside stop for the centrifugal pendulum, and that the centrifugal pendulum which has pivoted counter to the force of the restoring spring upon attainment of the shutoff rpm rests on the outer stop with a middle region located between the flyweight mass and the end of the second lever arm secured on the band bearing.

10. A centrifugal switch as defined by claim 9, wherein the restoring spring is suspended in the middle region of the centrifugal pendulum.

11. A centrifugal switch as defined by claim 10, wherein the rolloff surface is embodied by an arcuate rolloff path.

12. A centrifugal switch as defined by claim 11, wherein the inside position of the centrifugal pendulum the flyweight mass has the rotary axis passing through it and a smaller portion of the mass is located on the side of the rotary axis opposite the pivoting direction of the centrifugal pendulum.

13. A centrifugal switch as defined by claim 12, wherein the center of mass of the flyweight mass and the rolloff surface of the band bearing are disposed on opposite sides of the rotary axis.

14. A centrifugal switch as defined by claim 13, wherein the actuation pin of the switch is secured on a movable contact and passes with little play through a bore of a cover plate, in which a recess of a cap receives the switch and separates it from an interior chamber receiving the remaining structural parts.

15. A centrifugal switch as defined by claim 13, wherein the actuation pin of the switch is secured on a movable contact and passes with little play through a bore in a rigid carrier plate preferably receiving the fixed switching contact and that the carrier plate surrounds the actuation pin with a rim region which is at least 1 centimeter wide.

16. A centrifugal switch as defined by claim 15, wherein the second lever arm of the centrifugal pendulum, the metal band and the carrier element are held together by means of a spring element enclosing these elements in the region of the contact points of the band bearing and being subject to an initial tension force.

17. A centrifugal switch as defined by claim 16, wherein the spring element is embodied as a bracket spring and is suspended with two bent spring ends in bores of the carrier element and rests with a middle bracket portion in a spring receiver located on the second lever arm of the centrifugal pendulum.

18. A centrifugal switch as defined by claim 17, wherein the spring receiver is embodied as a depression in a pressure piece secured on the second lever arm of the centrifugal pendulum and serving to displace the actuation pin.

19. A centrifugal switch as defined by claim 18, wherein an articulation point is present on the centrifugal pendulum—on its second lever arm and in the rotary axis—between an element of the centrifugal pendulum firmly connected with the flyweight mass and a sheet-metal tongue firmly connected with the band bearing.

20. A centrifugal switch as defined by claim 18, wherein an intentional bending point is provided on the centrifugal pendulum between the flyweight mass and the band bearing which is rigid in the pivoting direction but elastic in the direction perpendicular thereto.

21. A centrifugal switch as defined by claim 6, wherein the carrier element or a structural part firmly connected therewith is provided with a centering bore receiving a tang of the drive shaft.

22. A method of operation for producing the centering bore in a centrifugal switch comprising the steps:

(a) rotating the flyweight unit of the centrifugal switch with the center of mass of the flyweight mass located approximately in the rotary axis, on a receiver flange of a bore apparatus;

(b) driving the receiver flange via a drive flange with the prescribed shutoff rpm;

(c) displacing the installed position of the flyweight unit out of the original installed position into a position which relative to the center of mass is more remote from the rotary axis, either continuously with a running drive flange by means of the receiver flange which is adjustable perpendicular to the rotary axis or repetitively by means of the step-by-step adjustment of the receiver flange or by means of the step-by-step displacement of the flyweight unit on the receiver flange, until such time as the centrifugal pendulum pivots outward for the purpose of interrupting contact; and (d) drilling in the position of the flyweight unit furnished according to method step (c) the centering bore by means of a drilling tool located in the rotary axis of the drive flange.

* * * * *